United States Patent [19]

Boutin et al.

[11] Patent Number: 5,064,513

[45] Date of Patent: Nov. 12, 1991

[54] DIAPHRAGM FOR MOLTEN BATH SALT ELECTROLYSIS OF METAL HALIDES

[75] Inventors: Jean Boutin, St. Martin d'Heres; Pierre Brun, Grenoble; Airy-Pierre Lamaze, Jarrie, all of France

[73] Assignee: Compagnie Europeenne du Zirconium Cezus, Courbevoie, France

[21] Appl. No.: 478,639

[22] Filed: Feb. 12, 1990

[30] Foreign Application Priority Data

Feb. 28, 1989 [FR] France ..... 89 03120

[51] Int. Cl.[5] ..... C25C 3/00; C25C 3/08

[52] U.S. Cl. ..... 204/64 R; 204/1.5; 204/64 T; 204/67; 204/243 R; 204/295

[58] Field of Search ..... 204/295, 243 R, 294, 204/67, 290 R, 64 R, 64 T, 1.5

[56] References Cited

U.S. PATENT DOCUMENTS

| | | | |
|---|---|---|---|
| 3,829,327 | 8/1974 | Omori et al. | 204/294 |
| 4,369,104 | 1/1983 | Beckly | 204/290 R |
| 4,670,110 | 6/1987 | Withers et al. | 204/69 |

*Primary Examiner*—John Niebling
*Assistant Examiner*—Kathryn Gorgos
*Attorney, Agent, or Firm*—Dennison, Meserole, Pollack & Scheiner

[57] ABSTRACT

A diaphragm is disclosed for molten salt bath electrolysis of metal halides, the diaphragm comprising carbon fibers disposed in one plane an in at least one direction, embedded at least partially in a rigid and inert material which can be graphite, carbides, oxides or nitrides. The diaphragm has a porosity between 10% and 60% in the form of apertures of an area between 1 and 50 $mm^2$.

19 Claims, No Drawings

DIAPHRAGM FOR MOLTEN BATH SALT ELECTROLYSIS OF METAL HALIDES

BACKGROUND OF THE INVENTION

1. Field of the Invention

The present invention relates to a diaphragm for the molten salt bath electrolysis of halides of metals. It relates to all metals which have a plurality of valency states, that is to say the polyvalent metals such as, in particular, titanium, zirconium, hafnium, thorium, vanadium, niobium, tantalum, chromium, molybdenum, tungsten, uranium, plutonium and also the rare earth metals.

2. Description of Related Art

A man skilled in the art knows that it is possible to obtain a metal by introducing one of its derivatives such as a halide, for example, into a molten salt bath and subjecting it, in its simplest principle, to the action of two electrodes connected to the poles of a direct current source. Halogen is given off at the anode and the metal is deposited on the cathode. This technique, which is referred to as dry electrolysis, has been the subject of many studies which have resulted in the conception of various processes which are distinguished from one another by the composition of the bath, the physical and chemical state of the halide, the modulation of the current system applied and to the production of multiple apparatuses which differ in terms of structure and shape, particularly where the electrodes, the systems of halide injection and recovery of the deposited metal are concerned.

However, all these cells have one point in common, which is the presence of a porous diaphragm which separates the anode from the cathode in such a way as to divide the bath into two distinct spaces: the anolyte and the catholyte. This diaphragm, which can be electrically polarized, has the effect of avoiding the halogen given off at the anode reoxidizing the reduced halides dissolved in the electrolyte when the metal has several valences.

This diaphragm generally consists either of a metal grid (see, for example, U.S. Pat. No. 2,789,983) or a porous graphite or ceramic member. However, these materials have their drawbacks. For example, the use of metal diaphragms results:

on the one hand, in chemical instability

- instability vis-a-vis the bath because the metals are capable of at least partially dissolving in it so that they pollute the metal which is to be deposited;
- instability vis-a-vis the halogen released which can corrode it to the point of destroying it locally and eliminating the separating between the anolyte and the catholyte;
- instability to the bath-atmosphere interface by electrochemical corrosion, and
- instability vis-a-vis the metal deposited by the formation of intermetallic compounds such as, for example, Ti-Ni or TiFe alloys which will render the diaphragm fragile.

There are just as many factors which help to limit the life of the diaphragm.

on the other, an electrical instability due to the fact that the diaphragm is the focal point of successive depositions and redissolutions of the metal to be deposited which change its porosity and affect maintenance of the optimum electrical deposition conditions; indeed, it is possible to follow the evolution of this porosity by measuring the potential and restoring it to suitable limits by polarization, as described in U.S. Pat. No. 4,392,924. However, the range of potential corresponding to normal running of the cell may be relatively narrow and of the order of 10 mV so that monitoring the porosity is no easy matter and it is easily possible to finish up with either a complete blocking of the diaphragm or an electrochemical attack on the diaphragm which more often than not results in the cell shutting down and the faulty diaphragm having to be replaced.

Furthermore, the diaphragm is generally extended upwardly and around the anode by a kind of bell or dome which is intended to channel the halogen released. Then, there are problems connected with the linking together of these two members which may give rise to mechanical and electrical difficulties, particularly in the case of polarized diaphragms.

With regard to graphite, it has the advantage over metals of being relatively insensitive to corrosion, but it does, however, have its drawbacks, viz.:

- Relatively high fragility which makes it sensitive to shocks and not suitable for machining operations such as screwthreading, for example, which would be necessary for connecting it to the dome or for the cutting of apertures to ensure the desired porosity;
- a troublesome tendency to absorb alkaline compounds from the bath which are inserted into the pores and cause it to burst;
- an aptitude to combine with certain metals which have to be deposited to form carbides which, in addition to enhanced fragility, alters its porosity and has a harmful effect on maintenance of optimum electrical conditions for deposition. With regard to ceramic diaphragms, apart from their fragility and their sensitivity to thermal shocks, they have the disadvantage of having very low electrical conductance, which means that they cannot be electrically polarized.

Consequently, they cannot lend themselves to the electrolytic redissolution of deposits which form on their surface so that it is impossible to monitor their porosity which renders them useless, particularly in the case of electrolysis of polyvalent metals.

SUMMARY OF THE INVENTION

That is why the Applicants, aware of all these drawbacks, have set out to find a material which makes it possible to overcome them. They have reached this object by perfecting a diaphragm for electrolysis of metal halides in a molten salt bath, characterized in that it consists of carbon fibers which are at least partially embedded in a rigid material which is inert vis-a-vis the bath, the whole assembly having a specific degree of porosity.

DETAILED DESCRIPTION OF THE INVENTION

Thus, the invention consists of a diaphragm which consists of a new base material: carbon fibers.

These fibers are assembled mechanically inter se in the form of panels which are a few millimeters thick and which can be easily cut or rolled up into the form of a cylinder. Preferably, panels are used in which the fibers are aligned in two different and intersecting directions in order to increase their rigidity. The panels obtained by weaving fibers in two perpendicular directions are particularly worth while.

However, by virtue of their flexibility, it would not be easy to maintain them in position in the baths, and this would result in variations in distance from the cathode or the anode and, hence, electrical fluctuations unfavorable to optimum operation of the cell. That is why these fibers are rigidified beforehand to ensure that they have a suitable mechanical stability. This rigidity is imparted to them by embedding them at least partially in a material which is in particular inert vis-a-vis the bath of electrolyte. Preferably, this substance is graphite which in this case does not have the drawbacks mentioned earlier because it is placed on a flexible substrate, but it is likewise possible to envisage carbon derivatives such as carbides or even oxides, nitrides and other substances which are capable of attaching themselves to the fibers. It is not necessary for this material to completely coat the fibers so long as it is used in a sufficient quantity to ensure suitable rigidity.

Where graphite is concerned, this may be the result of superficial graphitization of fibers obtained by heating to a sufficiently high temperature or by depositing on the said fibers graphite particles which result from the thermal decomposition of a hydrocarbon. With regard to the porosity, this may be achieved by employing panels either of large mesh woven fibres, for example which reconstitute the disposition of metal grids, or monodirectional or intersecting fibers on a close mesh basis in which the rigid material fills the spaces but where there are apertures of given dimensions. The combinations of these two types of porosity may likewise be envisaged. The said apertures may be obtained by suitable machining of the panels, including the use of sawing or piercing means, for example, or even by a localized combustion of the panel.

In any case, the dimensions of the apertures and their number are chosen in such a way as to produce a porosity of between 10 and 60% and preferably of 35 to 50%. Indeed, an excessive porosity results in migration in the direction of the anode of the ions of the metal which it is desired to deposit on the cathode while too low a porosity prevents passage of the alkaline or alkaline earth ions and halogen ions which ensure transport of the major part of the current.

This may be achieved on the basis of panels of which the mesh size and fiber thickness are appropriate or by making apertures in the form either of preferably vertical slots or holes of circular or polygonal contours.

In the case of slots, these are elongated over a fraction of the height of the diaphragm and have a width of between 0.5 and 10 mm and preferably between 2 and 5 mm, for the reasons mentioned earlier concerning the limits of porosity. With regard to the holes, still for the same reasons, their area should be between 1 and 50 sq.mm and preferably between 5 and 30 sq.mm.

It has likewise been found that it was preferable to limit the porosity of the diaphragm to the area facing the cathode in order in some cases to achieve an improvement in the way electrolysis was performed. Such a diaphragm makes it possible to remedy most of the drawbacks inherent in the prior art.

Indeed, in relation to the metals, carbon is insensitive to the majority of chemical compounds or elements under electrolysis conditions; its chemical stability is, therefore, ensured; that is to say, it does not pollute the deposited metal, does not corrode, does not become fragile and consequently, has a longer effective life, and an increased productivity due to the fact that stoppages of the cell required for changing the diaphragm are less frequent. Carbon likewise offers greater homogeneity of electrical potential which means better Faraday performance; that is to say, a lesser number of Coulombs than ususal, and a facility of polarity adjustment which avoids any blockage of the pores and obviously any destruction due to electrocorrosion.

Compared with graphite, it has no fragility, no tendency to absorb alkaline compounds and does not give rise to fragilisation by the formation of compounds with the metals deposited, so that there is likewise an increase in effective life with the resultant increase in productivity. Compared with ceramics, it offers good electrical conductance and total insensitivity to thermal or mechanical shocks.

Furthermore, these graphitized fibers lend themselves readily to the production of monobloc dome-diaphragm members, which thus avoids any difficulties of mechanical and electrical connection of the parts of the said members, as is the case with metallic diaphragms and graphite domes.

Finally, the fibers likewise, have the advantage of allowing an economical creation of localized porosity, which is not the case with a metallic grid nor with graphite diaphragms, where some of the holes would have to be blocked.

The invention will become more clearly understood from the description of the following embodiments, each of which establishes in the case of a given metal a comparison between the working conditions resulting from the use of a diaphragm according to the prior art and those which obtain according to the invention.

EXAMPLE NO. 1

The Case of Hafnium

Common conditions: electrolysis of hafnium chloride: HfC14 in a bath of molten alkaline and alkaline earth halides at a temperature of 750° C. and at a strength of 2800 Amperes with an anodic current density of 0.4 A/sq.cm and a cathodic current density of 0.2 A/sq.cm and using a diaphragm having a porosity of 40% and so polarized as to produce about 85 kg hafnium per day with a Faraday efficiency of between 83 and 87%.

1a—use of a nickel-based diaphragm in the form of a square mesh grid:
- diaphragm polarization current: 2 to 3% of the cathodic current
- effective life of the diaphragm: 1 to 3 months
- nickel content of the hafnium: 20 to 100 ppm.

1b—use of a carbon fibers diaphragm with the fibers organized in a plane according to two directions, embedded in a graphite material and comprising vertical slots
- polarization current: 1.5 to 2.5% of the cathodic current
- effective life of the diaphragm: 4 to 9 months
- nickel content of the hafnium: $<10$ ppm It is found that the use of graphitized carbon fibers results in a reduction in the polarization current, an improvement in the purity of the metal obtained and a considerable lengthening of the effective life of the diaphragm.

EXAMPLE NO. 2

The Case of Zirconium

Common conditions: electrolysis of zirconium chloride $ZrCl_4$ under the same conditions as those of the $HfCl_4$ except with regard to the quantity of metal produced which in this case is close to 35 kg/day, and the Faraday efficiency.

2a—use of a diaphragm in the form of a stainless steel grid type 304, that is to say one which has as its composition by weight: 18% Cr, 10% Ni and the balance Fe
- Faraday efficiency: 65 to 70%
- polarization current: 4 to 5% of the cathodic current
- effective life of the diaphragm: 10 to 30 days
- impurities contained in the zirconium obtained:
  - chromium: 200 ppm
  - iron: 150 ppm
  - nickel: 50 ppm 2b—use of a diaphragm consisting of carbon fibers organized in a plane following two directions embedded in a graphite material and comprising vertical slots:
- Faraday efficiency: 72 to 75%
- polarization current: 1.5 to 2.5% of the cathodic current
- effective life of the diaphragm: 4 to 9 months
- impurities contained in the zirconium obtained:
  - chromium: <20 ppm
  - iron: <50 ppm
  - nickel: <10 ppm It will be noted that the use of graphitized carbon fibers results in an enhanced Faraday efficiency; a diminution of the polarization current, a considerable increase in the effective life of the diaphragm and greater purity in the metal produced.

EXAMPLE NO. 3

The Case of Titanium.

Common conditions: electrolysis of titanium chloride $TiCl_4$ in a bath of molten alkaline and earth alkaline halides at a temperture of 800° C. under a strength of 1500 Amperes and using a diaphragm with 25% porosity and polarized in such a way as to produce approx. 7.5 kg titanium per day.

3a—use of a nickel based diaphragm in a grid shape
- Faraday efficiency: 50 to 55%
- polarization current: 10 to 15% of the cathodic current
- effective life of the diaphragm: 30 to 45 days
- impurities contained in the resultant titanium:
  - nickel: 50 ppm
  - chromium: 150 ppm
- during electrolysis, titanium-nickel intermetallic compounds form on the diaphragm which become fragile and make it impossible to use it again.

3b—use of a graphitized carbon fiber diaphragm
- Faraday efficiency: 60 to 65%
- polarization current: 5 to 8% of the cathodic current
- effective life: 60 to 180 days
- impurities contained in the resultant titanium:
  - nickel: <10 ppm
  - chromium: <20 ppm There is an overall improvement in the conditions compared, and furthermore, it is possible for the diaphragm to be used again.

EXAMPLE NO. 4

The Case of Niobium

Common conditions: electrolysis of niobium chloride $NbCl_5$ in a bath of molten alkaline and earth alkaline halides at a temperature of 800° C. under a strength of 300 Amperes and using a diaphragm with a 20% porosity in order to produce approx. 2.3 kg niobium per day with a Faraday efficiency of between 60 and 65%.

4a—use of a graphite diaphragm having vertical slots

4b—use of a diaphragm consisting of graphitized carbon fibers

With both types of diaphragm, the effective life may extend up to 90 days. However, with the graphite, mechanical breakages can occur after a few days use, and the fibers are not at the root of this random phenomenon. Furthermore, the graphite becomes impregnated with alkaline salts which cause it to burst which, in contrast to the fibers, makes it impossible to use it again after it has emerged from the bath.

EXAMPLE NO. 5

The Case of Tantalum

Common conditions: electrolysis of tantalum chloride $TaCl_5$ in a bath of molten alkaline and earth alkaline halides at a temperature of 850° under a strength of 300 Amperes, using a diaphragm with 45% porosity, polarized with a current equal to 4 to 5% of the cathodic current in order to produce approx. 6.1 kg tantalum per day.

5a—use of a steel diaphragm
- Faraday efficiency: 70 to 75%
- effective life of the diaphragm: 20 to 30 days
- iron content of the tantalum produced: 100 to 150 ppm 5b—use of a graphitized carbon fiber diaphragm
- Faraday efficiency: 95%
- effective life of the diaphragm: 4 to 6 months
- iron content of the tantalum obtained: <50 ppm It is found that the use of graphitized carbon fibers considerably improves the Faraday efficiency; the effective life results in a product of increased purity.

EXAMPLE NO. 6

The Case of Uranium

Common conditions: electrolysis of uranium chloride $UCl_4$ in a bath of molten alkaline and earth alkaline halides at a temperature of 720° C. under a strength of 200 Amperes with an anodic current density of 0.4 A/sq.cm and a cathodic current density of 0.3 A/sq.cm using a diaphragm of 40% porosity and polarized in order to produce approx. 6 kg uranium per day.

6a—use of a nickel base diaphragm in the form of a grid
- Faraday efficiency: 65 to 70%
- polarization current: 4 to 5% of the cathodic current
- effective life: 45 to 60 days
- impurities contained in the uranium obtained:
  - iron: 40 ppm
  - nickel: 50 to 75 ppm
  - chromium: 50 ppm 6b—use of a graphitized carbon fiber diaphragm Faraday efficiency: 70 to 75%
polarization current: 2 to 4% of the cathodic current
effective life: 150 to 300 days
impurities contained in the uranium obtained:
iron, nickel and chromium cannot be measured.

It is found that the use of a diaphragm consisting of graphitized carbon fibers results in an improvement in the Faraday efficiency, a reduction in the polarization current, an increase in the effective life of the diaphragm and an improved purity of the metal produced.

EXAMPLE NO. 7

The Case of Chromium

Common conditions: electrolysis of chromium chloride $CrCl_3$ in a bath of molten alkaline and earth alkaline halides at a temperature of 800° C. under a strength of 10 Amperes with an anodic current density of 0.2 A/sq.cm and a cathodic current density of 0.1 A/sq.cm in such a way as to produce 40 g chromium per day.

7a—use of a nickel diaphragm in the form of a grid and having a 10% porosity
Faraday efficiency: 30 to 40%
effective life >45 days
impurities contained in the chromium produced:
nickel: 300 to 500 ppm
iron: 100 to 150 ppm 7b—use of a graphitized carbon fiber diaphragm of porosity 20%
effective life >60 days
impurities contained in the chromium produced
nickel: <50 ppm
iron: 50 ppm It is found that the use of a graphitized carbon fiber diaphragm results in an improvement in the Faraday efficiency and in the effective life of the diaphragm and also results in greater purity in the chrome produced.

In all the examples given, over and above the advantages indicated, it is likewise found that there is as facility for monitoring the porosity of the diaphragm which is reflected in operation over a latitude of polarization potential control which extends over a range of 250 mV whereas with conventional diaphragms this range is reduced to 10 mV.

The invention is applied to the obtaining of high purity polyvalent metals where it makes it possible more easily to carry out electrolysis, the improved effective life of the diaphragm ensuring gains in productivity.

What is claimed is:

1. A diaphragm for molten salt bath electrolysis of metal halides comprising carbon fibers disposed in one plane and in at least one direction, embedded at least partially in a rigid and inert material consisting essentially of graphite, said diaphragm having a porosity between 10% and 60% in the form of apertures of an area between 1 and 50 $mm^2$ and having a width.

2. A diaphragm according to claim 1, wherein the fibers are disposed in two directions.

3. A diaphragm according to claim 2, wherein the two directions are substantially at right-angles to each other.

4. A diaphragm according to claim 1, wherein the graphite is a product of superficial graphitizing of the fibers.

5. A diaphragm according to claim 1, wherein the graphite is a deposit from thermal decomposition of a hydrocarbon.

6. A diaphragm according to claim 1, wherein the porosity comprises pores which are a product of disposing the fibers and distributing the rigid material.

7. A diaphragm according to claim 1, wherein the porosity comprises pores which are a product of machining of the embedded fibers.

8. A diaphragm according to claim 1, wherein the porosity comprises pores which are a product of localized combustion of the embedded fibers.

9. A diaphragm according to claim 1, wherein the porosity is between 35 and 50%.

10. A diaphragm according to claim 1, wherein the porosity is in the form of longitudinal slots of a width of between 0.5 and 10 mm.

11. A diaphragm according to claim 10, wherein the width is between 2 and 5 mm.

12. A diaphragm according to claim 1, wherein the area is between 5 and 30 $mm^2$.

13. A diaphragm according to claim 1, wherein the porosity is limited to a portion of the diaphragm.

14. A diaphragm according to claim 1, having a coating thereon of a metal having a plurality of valence states.

15. A diaphragm according to claim 1, which is operable over a polarization potential latitude of 250 mV.

16. A cell for electrolytic deposition of a metal, comprising:

a) a cell container containing therein a halide of the metal to be deposited in a molten salt bath;
b) an anode and a cathode disposed within said molten salt bath, said anode and said cathode each being adapted for connection to an electric current source;
c) a diaphragm disposed within said molten salt bath between said anode and cathode and separating said cell into an anolyte compartment and a catholyte compartment, said diaphragm comprising carbon fibers disposed in one plane and in at least one direction, embedded at least partially in a rigid and inert material consisting essentially of graphite, said diaphragm having a porosity between 10% and 60% in the form of apertures of an area between 1 and 50 $mm^2$.

17. A cell according to claim 16, wherein the porosity is limited to the zone of the diaphragm facing said cathode.

18. A cell according to claim 16, wherein said metal is selected from the group consisting of hafnium, zirconium, titanium, niobium, tantalum, uranium, and chromium.

19. A process for electrolysis of a metal halide in a molten salt bath, comprising:

a) disposing said metal halide and molten salt bath in a cell comprising an anode and a cathode;
b) separating said anode and cathode with a diaphragm comprising carbon fibers disposed in one plane and in at least one direction, embedded at least partially in a rigid and inert material consisting essentially of graphite, said diaphragm having a porosity between 10% and 60% in the form of apertures of an area between 1 and 50 $mm^2$;
c) passing an electric current between said anode and said cathode to deposit the metal of said halide at said cathode and generate the halogen of said halide at said anode.

* * * * *